US009658023B1

(12) United States Patent
Powell

(10) Patent No.: US 9,658,023 B1
(45) Date of Patent: May 23, 2017

(54) HAND HELD THROWING APPARATUS AND METHOD

(71) Applicant: Richard Powell, Austin, TX (US)

(72) Inventor: Richard Powell, Austin, TX (US)

( * ) Notice: Subject to any disclaimer, the term of this patent is extended or adjusted under 35 U.S.C. 154(b) by 0 days.

(21) Appl. No.: 14/684,761

(22) Filed: Apr. 13, 2015

Related U.S. Application Data

(60) Provisional application No. 62/023,992, filed on Jul. 14, 2014.

(51) Int. Cl.
*F41B 3/03* (2006.01)
*F41B 3/00* (2006.01)

(52) U.S. Cl.
CPC ..... *F41B 3/005* (2013.01)

(58) Field of Classification Search
CPC .... F41B 3/03; F41B 3/005; F41B 7/00; F41B 11/642
See application file for complete search history.

(56) References Cited

U.S. PATENT DOCUMENTS 970,018 A * 9/1910 Coleman ..... F41B 7/006 102/371
1,091,512 A * 3/1914 Hoffman ..... A63B 69/408 124/36
1,268,187 A * 6/1918 Velk ..... A63B 69/408 124/7
1,287,780 A * 12/1918 Stanard ..... F41B 11/642 124/66
1,381,639 A * 6/1921 Hess ..... F41B 7/00 124/26
1,457,674 A * 6/1923 Kennedy ..... A01M 3/027 124/36
1,726,534 A * 9/1929 Berger ..... F41B 7/003 124/2
1,841,390 A * 1/1932 Welch ..... F41B 3/03 124/7
2,318,139 A * 5/1943 Calabrese ..... F41B 3/03 124/35.1
4,719,897 A * 1/1988 Gaudreau ..... F41B 5/1469 124/25
4,774,786 A * 10/1988 Zaremba ..... A01M 3/027 124/18
4,827,894 A * 5/1989 Schallberger ..... F41B 5/12 124/25
5,979,424 A * 11/1999 Alvarez ..... F41B 7/08 124/16

(Continued)

*Primary Examiner* — Melba Bumgarner
*Assistant Examiner* — Amir Klayman
(74) *Attorney, Agent, or Firm* — J. Nevin Shaffer, Jr.

(57) ABSTRACT

A hand held throwing apparatus and method includes of a U-shaped body with two sides and a bottom forming an open interior, the U-shaped body having an open front and an open back. A combination throwing-cocking arm with a first end and a second end is provided where the second end is rotatably connected with the U-shaped body in proximity to the open front in between the two sides. A spring is provided with a first end and a second end, where the first end of the spring is attached to the second end of the combination throwing-cocking arm and the second end of the spring is connected with the U-shaped body. A stop device is attached to the combination throwing-cocking arm between the first end and the second end and a handle is connected to the U-shaped body.

16 Claims, 5 Drawing Sheets

(56) References Cited

U.S. PATENT DOCUMENTS

| | | | | |
|---|---|---|---|---|
| 8,393,299 | B1 * | 3/2013 | Bernat | A01K 15/025<br>119/702 |
| 2014/0311470 | A1 * | 10/2014 | Sievers | A63H 33/18<br>124/7 |
| 2016/0016095 | A1 * | 1/2016 | Aguila | A63H 37/00<br>124/16 |

* cited by examiner

HAND HELD THROWING APPARATUS AND METHOD

CROSS REFERENCE TO RELATED APPLICATION

This application claims the benefit of previously filed U.S. provisional patent application No. 62/023,992 filed Jul. 14, 2014 for a "Hand Held Ball Throwing Apparatus and Method". The Applicant hereby claims the benefit of this provisional application under 35 U.S.C. §119. The entire content of this provisional application is incorporated herein by this reference.

FIELD OF THE INVENTION

This invention relates to a hand held throwing device. In particular, in accordance with one embodiment, the invention relates to a hand held throwing apparatus consisting of a U-shaped body with two sides and a bottom forming an open interior, the U-shaped body having an open front and an open back. A combination throwing-cocking arm with a first end and a second end is provided where the second end is rotatably connected with the U-shaped body in proximity to the open front in between the two sides. A spring is provided with a first end and a second end, where the first end of the spring is attached to the second end of the combination throwing-cocking arm and the second end of the spring is connected with the U-shaped body. A stop device is attached to the combination throwing-cocking arm between the first end and the second end and a handle is connected to the U-shaped body.

BACKGROUND OF THE INVENTION

A problem exists with regard to the use of devices used for throwing objects. By way of example only and not by limitation, in order to practice many sports, such as baseball, again for example only, it is necessary to practice hitting and catching baseballs. The problem is that prior art devices for throwing baseballs are costly, cumbersome, complicated, and incapable of hand held operation. Further, most prior art throwing devices require power to operate and, thus, are not suitable for use where power is unavailable, or if battery powered, where power is depleted altogether.

Thus, there is a need in the art for an apparatus and method for enabling a user to operate a hand held device for repeatedly throwing objects that is light weight, easy to use and does not require electricity.

It therefore is an object of this invention to provide a hand held throwing device the is easy for anyone to use, that does not require electricity, that is portable and that is adjustable in direction and speed, among other things as will be more fully described hereafter.

SUMMARY OF THE INVENTION

Accordingly, the hand held throwing apparatus of the present invention, according to one embodiment, includes a U-shaped body with two sides and a bottom forming an open interior, the U-shaped body having an open front and an open back. A combination throwing-cocking arm with a first end and a second end is provided where the second end is rotatably connected with the U-shaped body in proximity to the open front in between the two sides. A spring is provided with a first end and a second end, where the first end of the spring is attached to the second end of the combination throwing-cocking arm and the second end of the spring is connected with the U-shaped body. A stop device is attached to the combination throwing-cocking arm between the first end and the second end and a handle is connected to the U-shaped body.

All terms used herein are given their common meaning so that, for example, "U-shaped body" identifies and describes a structure with raised sides connected by a bottom to form a generally "U" shape in that no enclosing top is present. The "U" shape is not limiting in that it is not required that it include rounded bottom edges and may include sides connected at right angles to a bottom for example only. Importantly, and open interior is created by the structure of the body and preferably the ends of the body are "open" as well. That is, the structure is not a box with an open top but, again, a U-shaped structure with an open top as well as a generally open front and back, as illustrated and discussed herein.

Likewise, "combination throwing-cocking arm" describes a single structure that serves two separate purposes, to wit, throwing an object and cocking the device, all again as will be more fully described hereafter.

According to another aspect, the invention further includes a spring adjustment rod where the second end of the spring is connected to the spring adjustment rod and spaced apart spring adjustment slots are provided in the U-shaped body and the spring adjustment slots are conformed to receive and removably retain the spring adjustment rod. By this structure it is to be understood that more or less tension may be applied to the springs so as to allow the user to adjust the speed of the movement of the combination throwing-cocking arm, as is described more fully hereafter.

According to another aspect, the spring adjustment rod extends from side to side across the open interior and the spring adjustment slots consist of pairs of oppositely positioned spring adjustment slots in the sides. In a further aspect, the spring adjustment rod includes grips where the grips extend beyond the sides of the U-shaped body.

In another aspect, the invention further includes a spring relaxation slot connected with the spring adjustment slot and the spring adjustment rod fits within the spring relaxation slot.

In one aspect, the device further includes at least one projection connected with at least one side of the U-shaped body where the at least one projection extends into the open interior of the U-shaped body. In a further aspect, two projections are connected with the U-shaped body, a first projection connected to one side and a second projection connected to the opposite side and the two projections are oppositely positioned and facing each other across the open interior.

In one aspect, a holder is provided at the first end of the combination throwing-cocking arm. In another aspect, the holder is a pad that extends beyond the first end of the combination throwing-cocking arm and at least partially to either side of the first end of the combination throwing-cocking arm.

In another aspect, the first end of the combination throwing cocking arm extends beyond the open front when uncocked and where the first end of the combination throwing cocking arm is located between the sides at the open back when cocked. Here the terms "cocked" and "uncocked" are understood by reference to the figures, such as FIG. 1 that shows the device in an "uncocked" position and FIGS. 8-10 that show the device in a "cocked" position, as will be more fully described hereafter.

In a further aspect, the present invention further includes a spring attachment stud connected with the second end of the combination throwing-cocking arm where more than one spring is connected with the spring attachment stud and where more than one spring is also connected with the U-shaped body.

According to another embodiment, the hand held throwing apparatus of the present invention includes a U-shaped body with two sides and a bottom forming an open interior, the U-shaped body having an open front and an open back. A combination throwing-cocking arm, with a first end and a second end, is connected with an arm axle. The arm axle is connected with the U-shaped body in proximity to the open front in between the two sides and within the open interior. A spring, with a first end and a second end, is attached to the second end of the combination throwing-cocking arm. An adjustable stop device is attached to the combination throwing-cocking arm between the first end and the second end. A spring adjustment rod is provided where the second end of the spring is connected to the spring adjustment rod and spaced apart spring adjustment slots are provided in the U-shaped body where the spring adjustment slots are conformed to receive and removably retain the spring adjustment rod. Two projections are connected with the U-shaped body, a first projection connected to one side and a second projection connected to the opposite side and the two projections are oppositely positioned and facing each other across the open interior. A handle is connected to the U-shaped body at the bottom of the U-shaped body in proximity to the open back.

In another aspect, the spring adjustment rod extends from side to side across the open interior and the spring adjustment slots consist of pairs of oppositely positioned spring adjustment slots in the sides. In a further aspect, the spring adjustment rod includes grips and the grips extend beyond the sides of the U-shaped body.

In one aspect, the invention further includes a spring relaxation slot connected with the spring adjustment slot and the spring adjustment rod fits within the spring relaxation slot.

In another aspect, the invention further includes a holder where the holder is a pad connected with the first end of the combination throwing-cocking arm and where the holder extends beyond the first end of the combination throwing-cocking arm and at least partially to either side of the first end of the combination throwing-cocking arm.

In one aspect, the invention further includes a spring attachment stud connected with the second end of the combination throwing-cocking arm. More than one spring is connected with the spring attachment stud and the more than one springs are also connected with the spring adjustment rod. Further, the spring attachment stud is located in between the arm axle and the second end of the throwing-cocking arm.

In another aspect, the invention further includes a hand stop extending from the bottom of the U-shaped body in between the handle and the open front.

According to another embodiment, a hand held throwing method includes the steps of:

a. providing a U-shaped body with two sides and a bottom forming an open interior, the U-shaped body having an open front and an open back; a combination throwing-cocking arm with a first end and a second end where the second end is rotatably connected with the U-shaped body in proximity to the open front in between the two sides; a spring with a first end and a second end, where the first end of the spring is attached to the second end of the combination throwing-cocking arm and the second end of the spring is connected with the U-shaped body; a stop device attached to the combination throwing-cocking arm between the first end and the second end; and a handle connected to the U-shaped body;

b. grasping the handle;

c. rotating the first end of the combination throwing-cocking arm back to the open back of the U-shaped body;

d. placing an object to be thrown at the stop device while holding the first end; and e. releasing the first end.

In another aspect, the method further includes:

a. providing a spring adjustment rod where the second end of the spring is connected to the spring adjustment rod;

b. providing spaced apart spring adjustment slots in the U-shaped body where the spring adjustment slots are conformed to receive and removably retain the spring adjustment rod; and c. adjusting tension on the spring by selectively placing the spring adjustment rod in one of the spring adjustment slots.

DESCRIPTION OF THE DRAWINGS

Other objects, features and advantages of the present invention will become more fully apparent from the following detailed description of the preferred embodiment, the appended claims and the accompanying drawings in which:

DETAILED DESCRIPTION OF THE INVENTION

Figure 1:
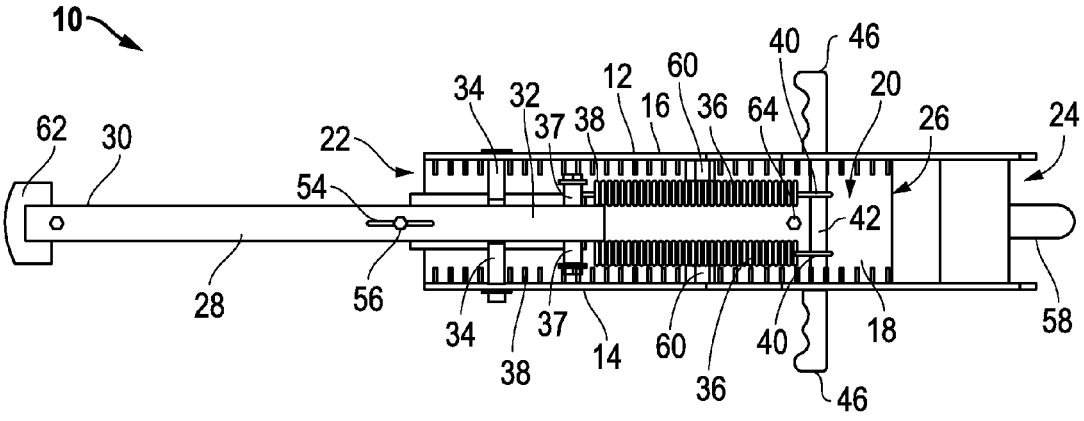
FIG. 1 is a top view of the hand held throwing apparatus of the present invention according to one embodiment.

Before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the invention be regarded as including equivalent constructions to those described herein insofar as they do not depart from the spirit and scope of the present invention.

For example, the specific sequence of the described process may be altered so that certain processes are conducted in parallel or independent, with other processes, to the extent that the processes are not dependent upon each other. Thus, the specific order of steps described herein is not to be considered implying a specific sequence of steps to perform the process. In alternative embodiments, one or more process steps may be implemented by a user assisted process and/or manually. Other alterations or modifications of the above processes are also contemplated.

In addition, features illustrated or described as part of one embodiment can be used on other embodiments to yield a still further embodiment. Additionally, certain features may be interchanged with similar devices or features not mentioned yet which perform the same or similar functions. It is therefore intended that such modifications and variations are included within the totality of the present invention.

It should also be noted that a plurality of hardware based devices, as well as a plurality of different structural components, may be utilized to implement the invention. Furthermore, and as described in subsequent paragraphs, the specific configurations illustrated in the drawings are intended to exemplify embodiments of the invention and that other alternative configurations are possible.

A preferred embodiment of the present invention is illustrated by way of example in FIGS. 1-10. With specific reference to FIGS. 1, 2 and 3, according to one embodiment, hand held throwing apparatus 10 includes a U-shaped body 12 with two sides 14 and 16 and a bottom 18. As illustrated U-shaped body 14 has an open top 20 as well as an open front 22 and an open back 24. Together, sides 14 and 16 and bottom 18 create an open interior 26 in that open interior 26 of U-shaped body 12 is formed by the two sides 14 and 16 and the bottom 18.

Combination throwing-cocking arm 28 has a first end 30 and a second end 32. Second end 32 is rotatably connected with U-shaped body 12. In one aspect, arm axle 34 is connected with combination throwing-cocking arm 28 and with the two sides 14 and 16 across open interior 26 in proximity to the open front 22 of U-shaped body 12, as illustrated. By "rotatably connected" it is understood that combination throwing-cocking arm 28 is held in position, as by arm axle 34 for example only, and when moved, the first end 30 and second end 32 of combination throwing-cocking arm 28 rotate about that location, i.e. the axle 34, but otherwise the position of combination throwing-cocking arm 28 is fixed within the U-shaped body 12.

A spring 36 with a first end 38 and a second end 40 is provided. There may be more than one spring 36, certainly, and two springs 36 are illustrated as a preferred embodiment. The first end 38 of the spring(s) 36 is attached to the second end 32 of the combination throwing-cocking arm 28 and the second end 40 of the spring(s) 36 is connected with the U-shaped body 12.

Preferably, second end 40 is connected with U-shaped body 12 by means of a spring adjustment rod 42 where the second end 40 of the spring 36 is connected to the spring adjustment rod 42. Spaced apart spring adjustment slots 44 (as more clearly shown in FIG. 4, for example) in the side(s) 14 and or 16 of U-shaped body 12 are provided and spring adjustment slots 44 are conformed to receive and removably retain spring adjustment rod 42. That is, as shown, spring adjustment slots 44 include an angle toward the open front 22. Once spring adjustment rod 42 is placed in the angle of spring adjustment slots 44 the tension from spring 36 securely keeps spring adjustment rod 42 in the selected slot 44.

As illustrated, spring adjustment rod 42 preferably extends across the open interior 26 from side 14 to side 16 of U-shaped body 12 and works in combination with oppositely positioned pairs of spring adjustment slots 44 to selectively place more or less tension in springs 36 resulting, as will be discussed more fully hereafter, in faster or slower movement of combination throwing-cocking arm 28.

In one aspect, grips 46 are added to the ends of spring adjustment rod 42. Grips 46 extend beyond the sides 14 and 16 on the outside of U-shaped body 12 as illustrated. Grips 46 enable a user to safely and securely move spring adjustment rod 42 against the tension of springs 36.

Additionally, spring relaxation slot 48 (as more clearly shown in FIG. 4) may be included. When present, spring relaxation slot 48 allows spring adjustment rod 42 to essentially completely relax tension on springs 16. That is, spring adjustment rod 42 travels within spring relaxation slot 48 in the direction of the connection of springs 36 connection with the second end 32 of combination throwing-cocking arm 28 thus allowing springs 36 to return to an un-tensioned or nearly un-tensioned position. This is useful for safety and shipping purposes as may be desired.

Figure 2:
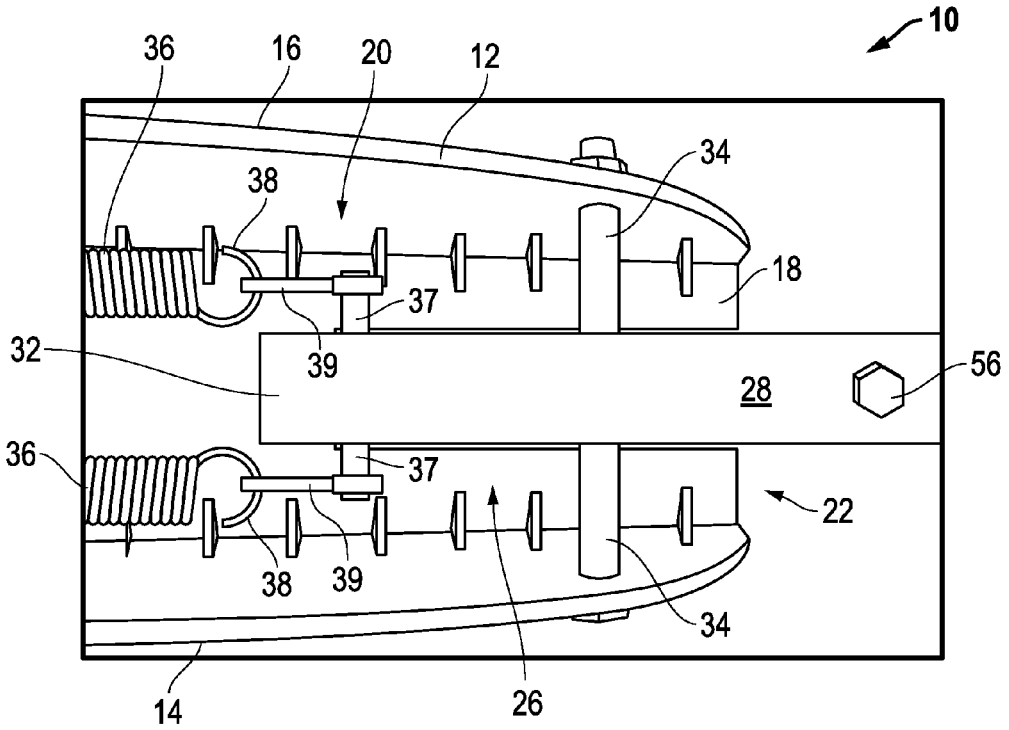
FIG. 2 is a close up view of the open front end of the invention of FIG. 1.
Figure 3:
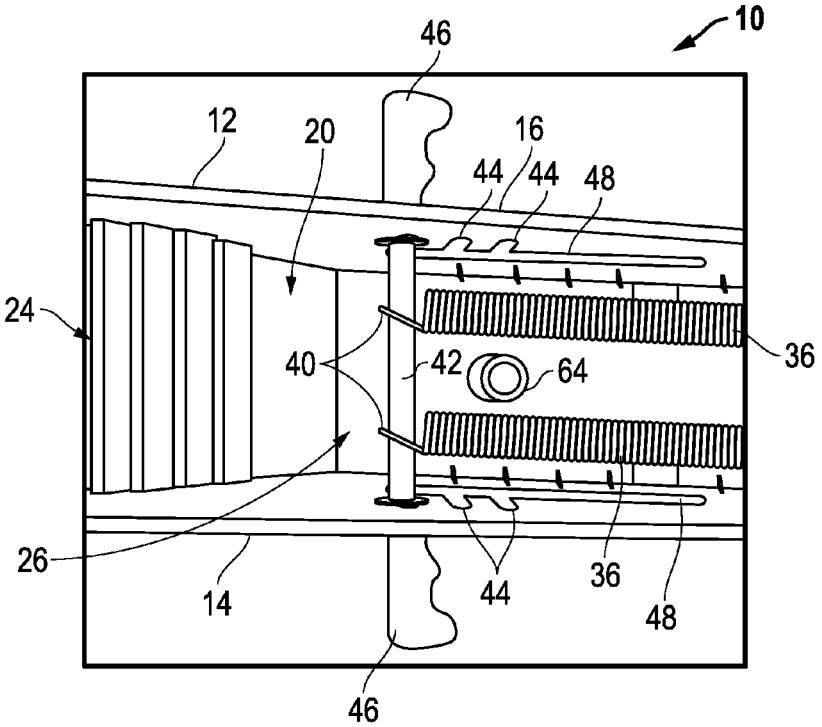
FIG. 3 is a close up view near the open back of the invention of FIG. 1.

Still referring to FIGS. 1-3, stop device 50 is attached to the combination throwing-cocking arm 28 between the first end 30 and the second end 32. Stop device 50 serves the function of providing a resting place for an object 52 prior to operation of the hand held throwing apparatus 10 to throw the object 52 as more fully illustrated in FIGS. 9 and 10. Stop device 50 may be any form or shape and is shown as a cylindrical post for example only. In one aspect, stop device 50 is adjustable such that it is movable along the length of combination throwing-cocking arm 28 by means of an adjustment slot 54, by way of example only and not by limitation. Nut 54 connected to the bottom of stop device 50 is loosened and then tightened once stop device 50 is positioned where desired, again, for example only, in adjustment slot 54, when present.

Handle 58 is connected to the U-shaped body 12. Preferably, handle 58 is connected to the bottom 18 in proximity to the open back 24 of U-shaped body 12 as illustrated. Other locations that are useful are suitable as well. Handle 58 may be in "pistol grip" form as illustrated or any other useful form.

Preferably, in one aspect of the invention, at least one projection 60 is connected with at least one side (14 or 16) of U-shaped body 12 where the at least one projection 60 extends into the open interior of said U-shaped body. In one preferred aspect, two projections 60 are provided, the two projections 60 oppositely positioned across the open interior 26 one on one side 14 and one on the other side 16. Projection(s) 60 define and provide a space between stop device 50 and the projections 60 into which object 52 is placed. Depending on the size of the object 52 projections 60 may assist in stabilizing the object prior to releasing combination throwing-cocking arm 28, as will be described more fully hereafter.

Figure 8:
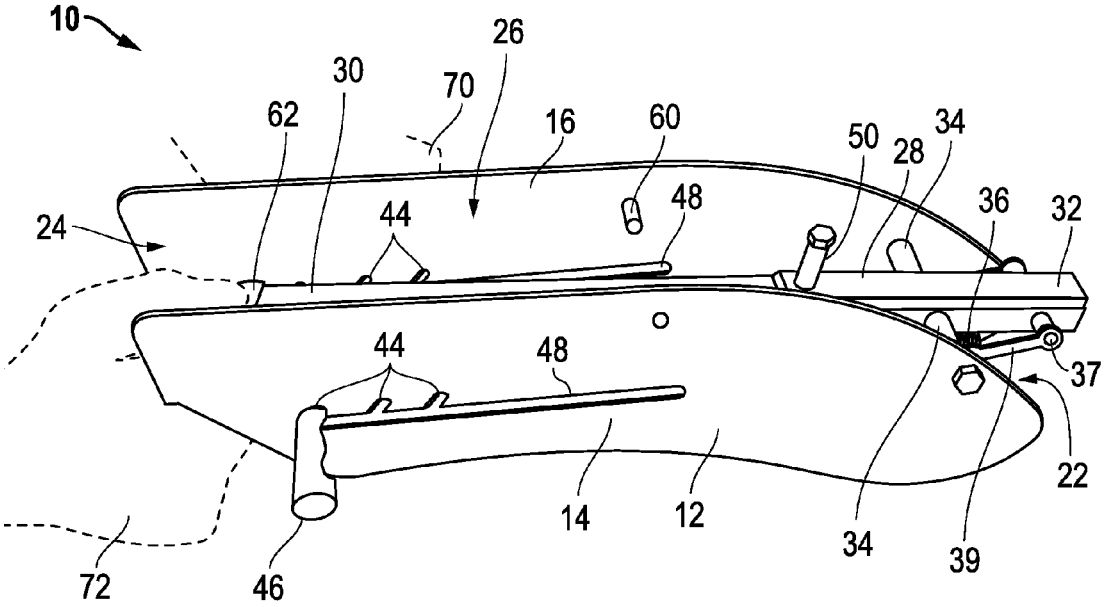
FIG. 8 is a perspective view showing the invention fully cocked.
Figure 9:
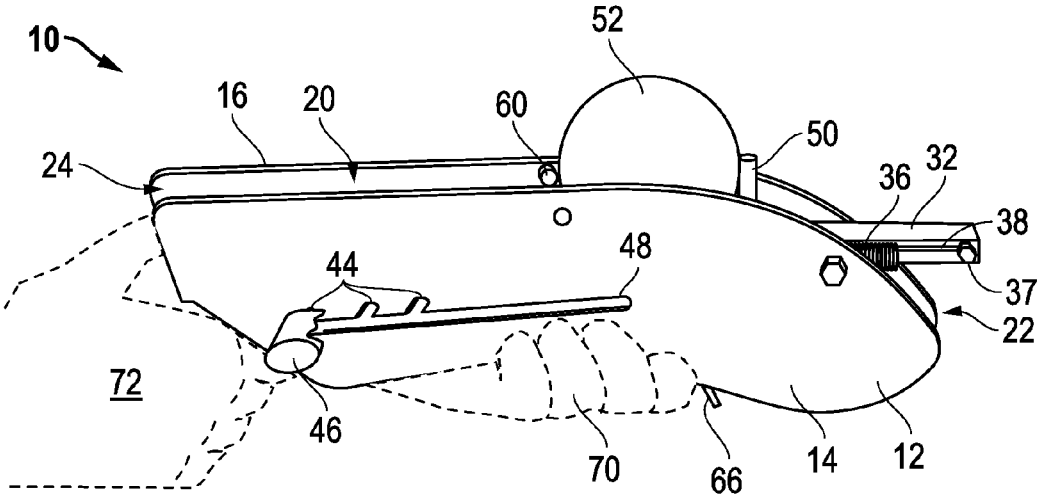
FIG. 9 is a perspective view showing the invention fully cocked with an object to be thrown placed on the combination throwing-cocking arm next to the stop device.
Figure 10:
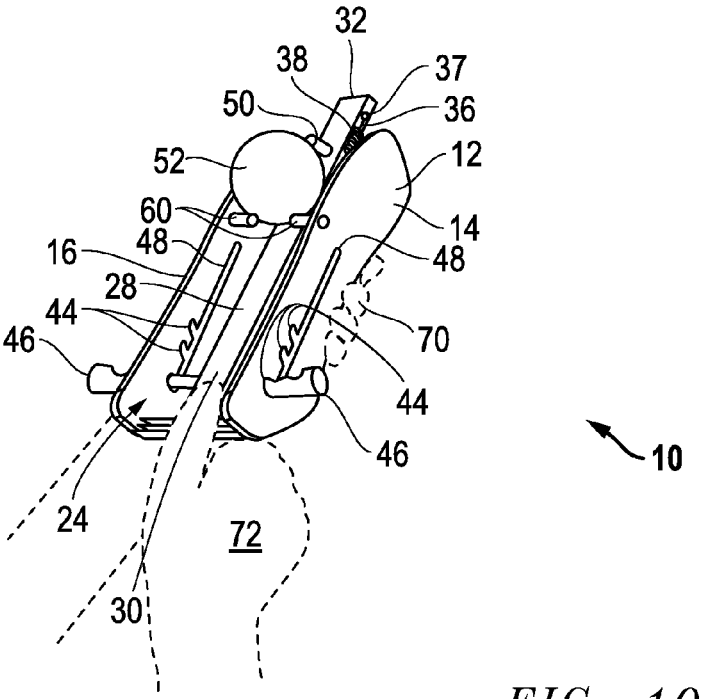
FIG. 10 is a perspective view of the invention of FIG. 9 illustrating the invention pointed upward before throwing the object.

FIG. 1 also illustrates pad 62 attached to the first end 30 of combination throwing-cocking arm 28. Pad 62 in one aspect extends in front of the first end 30 and beyond the edges of first end 30 as illustrated. Pad 62 forms a platform for a user to place his or her thumb in order to hold combination throwing-cocking arm 28 in the cocked position as shown in FIGS. 8, 9 and 10. Preferably, pad 62 is a soft rubber or plastic of any type now known or hereafter developed. Importantly, pad 62 provides protection against injury that might be caused by and unprotected first end 30 of combination throwing-cocking arm 28, however unlikely that event might be. That is, combination throwing-cocking arm 28 is made of light weight material, plastic, aluminum, or the like and has very little mass and presents no serious risk of injury. Nonetheless, pad 62 surrounds and shields the first end 30 and provides a soft place for the user to place his or her thumb to hold first end 30 down and in position for throwing an object 52 as will be discussed more fully hereafter.

FIG. 1 also shows a tripod connection 64 at the bottom 18. Tripod connection 64 cooperates with any desired tripod device (not shown) to support hand held throwing apparatus 10 at a certain height above the surface as may be deemed useful.

FIG. 2 illustrates another aspect of the invention to include a spring attachment stud 37 connected with the second end 32 of the combination throwing-cocking arm 28. Spring attachment stud 37 is useful to enable more than one spring 36 to be used. In use, as shown for example, the first end 38 of one spring 36 is connected to one side of spring attachment stud 37 and the first end 38 of another spring 36 is connected with the other side of spring attachment stud 37. The second ends 40 of the springs 36 are thereafter connected with the U-shaped body 12 as described and illustrated herein.

FIG. 2 also illustrates spring connection 39. When present, the first end 38 of spring 36 is connected with spring connection 39 and then spring connection 39 is connected with spring attachment stud 37. Spring connection 39 is rotatably connected with spring attachment stud 37 and thus spring 36 is not wrapped or stretched around spring attachment stud 37 as the arm 28 is cocked and released as is described more fully hereafter.

Figure 4:
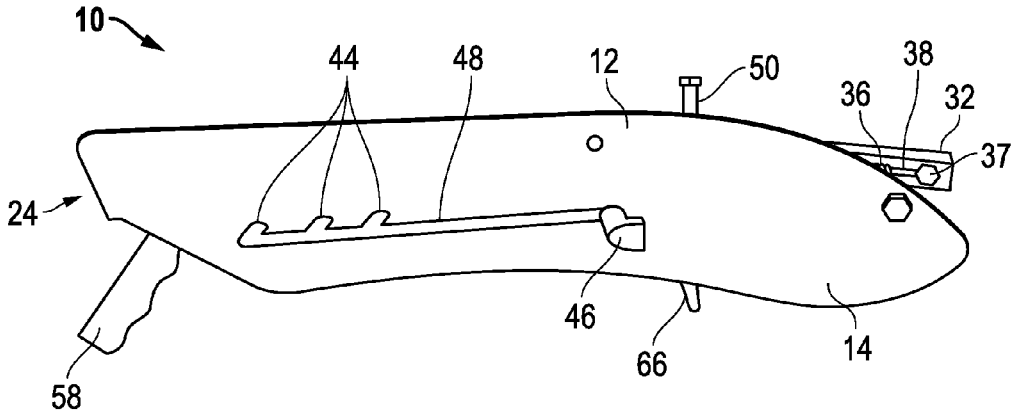
FIG. 4 is a side view of the invention of FIG. 1 illustrating the adjustment rod in the relaxation slot.

Referring now to FIG. 4, hand held throwing apparatus 10 is shown with spring adjustment rod 42 all the way at the end of spring relaxation slot 48 such that spring(s) 36 are under minimum or no tension. Again, this is a position useful when shipping the invention or for storing the apparatus between uses.

FIG. 4 also illustrates another aspect of the invention in the form of hand stop 66. Hand stop 66 is connected to the bottom 18 of U-shaped body 12 such that the user 68 can place one hand 70 at the hand stop 66 and use the other hand 72 to operate the apparatus. Preferably, hand stop 66 is connected to the bottom 18 in between handle 58 and the open front 22 of U-shaped body 12.

Figure 5:
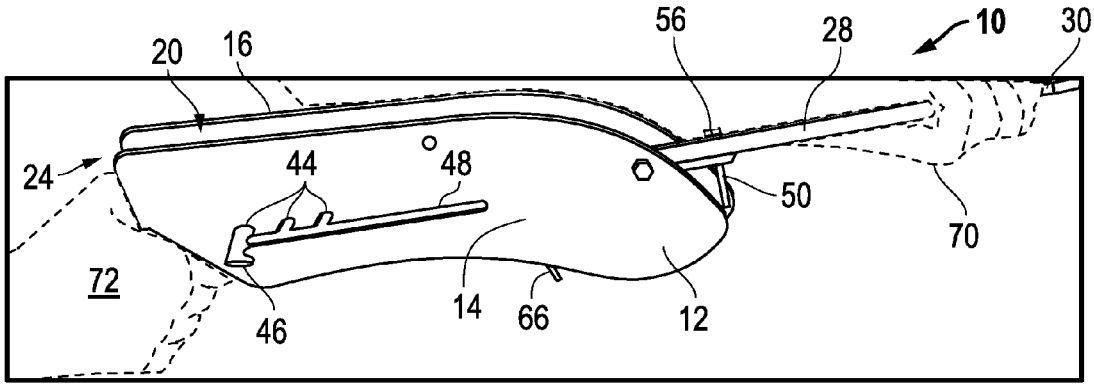
FIG. 5 is a perspective view showing a user gripping the combination throwing-cocking arm of the invention of FIG. 1 in preparation to cock the invention.

Referring now to FIGS. 5, 6, 7, 8, 9 and 10 the operation of hand held throwing apparatus 10 is described. In FIG. 5, the user 68 grips combination throwing-cocking arm 28 near the first end 30 with one hand 70 while holding on to handle 58 with the other hand 72. The closer to first end 30 the user 68 grabs combination throwing-cocking arm 28, the more leverage the user 68 has to cock the device. The user 68 begins the cocking maneuver by pulling combination throwing-cocking arm 28 from its extended position in front of the open front 22 toward the open back 24. As discussed, the combination throwing-cocking arm 28 is rotatably connected with U-shaped body 12, as by means of arm axle 34, and thus second end 32 rotates from its position facing the open back 24 toward a position facing the open front 22. This movement causes the springs 36 to stretch and become tensioned.

Figure 6:
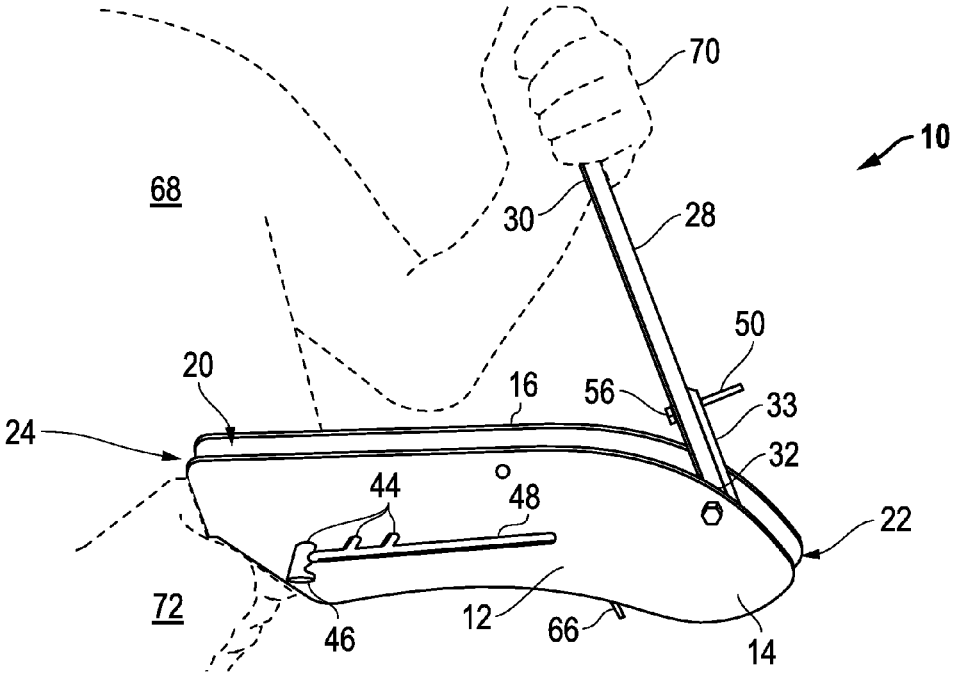
FIG. 6 is a perspective view showing the invention partially cocked.
Figure 7:
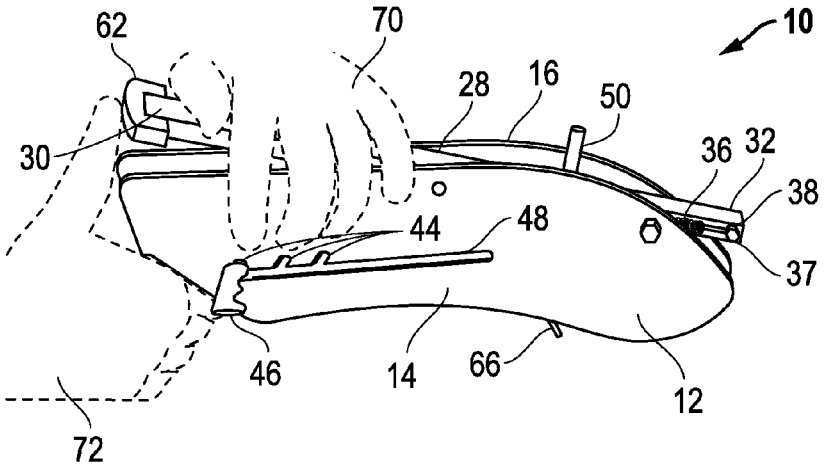
FIG. 7 is a perspective view showing the invention almost completely cocked.

FIG. 6 illustrates the motion of FIG. 5 as the user 68 continues to use first end 30 of the combination throwing-cocking arm 28 to "cock" the device. FIG. 7 illustrates the device almost fully "cocked" with the first end 30 now at the open back 24 and the second end 32 now at the open front 22. Pad 62 is presented for the user 68 to use the thumb of one hand 72 to hold the first end 30 down.

FIG. 8 illustrates the hand held throwing apparatus 10 in the fully "cocked" position.

FIG. 9 shows the hand held throwing apparatus 10 in the fully "cocked" position with an object 52, such as a ball, for example only and not by way of limitation, placed against stop device 50 and in between projections 60. The user's 68 hand 70 is placed up against hand stop 66 while hand 72 holds the first end 30 at pad 62 of combination throwing-cocking arm 28 ready for release when and where desired.

FIG. 10 shows a unique ability of the hand held throwing apparatus 10 in that it is fully capable of throwing an object 52 nearly straight up by object 52 being held in position by projections 60.

By way of further description, Applicant's hand held throwing apparatus 10 solves the need for a light weight, hand held device that users of all ages can safely handle and that can throw all types of objects 52 such as fore example only and not by limitation: tennis balls, golf balls, cricket balls, base balls, soft balls and the like as well as other objects such as clay pigeons, etc, at various speeds, accurately and repeatedly and without need of a powered motor. By way of testing, Applicant has determined that the light weight (the apparatus is mostly made of plastic and aluminum parts and/or any light weight material now known or hereafter developed), device can throw a regular baseball seventy mph with very little tension needed on the springs 36. Again, Applicant has determined the present invention can throw light weight balls at speeds at or exceeding one hundred mph.

Importantly, the arm 38, in order to be as light as possible is small and narrow. Thus the structure of the present invention uses the sides 14 and 16, or some other method, to hold the ball 52 in place as the arm 28 starts in motion. In combination with the side, the present invention uses stop device 50 on arm 28 and projections 60 in the side(s) 14 and 16, for example. Thereafter, the force against the ball 52 causes it to stay in position in the center of the arm 28 until it is released. This structure is what makes it possible to use as much of the available power as possible to throw the ball 52 and not be used up moving heavy wheels or heavier arms as with prior art devices. In sum, the lighter the arm 28, the more efficient the throw will be.

By way of continued explanation, projections 60 have enough cushion to hold the ball 52 in place when aiming up at the sky for high fly balls or straight up for catcher drills. That is, when throwing level or down, ball 52 may not even contact projections 60. When pointed up, however, as in FIG. 10, projections 60 keep the ball 52 in position on arm 28. Projections 60 may be of various dimensions and can be increased in dimension by simply adding a soft cushion cover, for example only.

A further advantage of this hand held throwing apparatus 10 is that, unlike stationary machines, each time it "throws" an object the user himself aims the device. Thus, once you have thrown the object the user knows how to aim it for each future throw. Like a real pitcher, for example, the user can throw the object up, down, left, right on any pitch and with more accuracy than most people or most other machines.

Further, extension springs 36 allow the power exerted from the cocking motion to be transferred to the axle 34 as the arm 28 rotates past the fulcrum so it is easy to hold down, allowing just the user's 68 thumb to hold down the arm 28 with just enough force to remind the operator it is cocked.

Applicant understands a trigger device could be used, but it would not be as safe since the machine could be left cocked and accidentally release and cause possible injury.

Applicant has determined, that since the majority of the tension in the springs 36 is transferred to the axle 34 as the second end 32 of combination throwing-cocking arm 28 moves past the fulcrum to right at 180 degrees (see FIGS. 5 to 6), it keeps the arm 28 from taking off too fast and causing the ball 52 to throw out and leave the arm 28 in an upward direction before the tangential velocity captures the ball 52 and causes it to leave the arm 28 at just the right point, in a direction that is in line with the hand held throwing apparatus 10. This enables the user 68 to aim the throw accurately for ground balls, level pitches, for example, and even throw fly balls including the straight up throw for catcher drills, which is unique to this machine. Machines costing thousands of dollars cannot throw straight up and at any angle.

Further, Applicant knows of no machine that can teach fielding by throwing balls to exact positions on every throw. The hand held throwing apparatus and method 10 allows a user 68 to make perfect throws to help beginners learn to catch; also one hop or two hop, etc., ground balls; sinking line drives or balls thrown to the edge of a players range. No prior art machine at any price can do this.

By way of further description, Applicant notes that if torsion springs were used, the tension would continue to increase as the arm 28 is cocked until full tension would be exerted in the final cocked position. The full tension would cause the arm 28 to take off at full speed and would throw the ball out or off of arm 28 before tangential velocity takes over the ball which is required in order to the throw in the direction the machine is pointed.

Further, Applicant has found that it is preferred that the arm 28 surface upon which the object 52 rest be smooth and/or slick or the object 52 will not slide up the arm 28 a bit during the throw. If the object does not slide a bit, Applicant has found the object will leave arm 28 in a downward direction eliminating the efficiency and accuracy of the throw.

Additionally, Applicant has determined that the present invention will throw all types of balls, but the aim will be slightly different for each type of ball. Further, this is the only machine that exists that can throw balls of different size, hardness, texture and weight, without making any changes to the machine and the operator will quickly learn to aim each ball accurately.

During tests, Applicant has used the present invention to machine to throw balls to beginners, with regulation weight safety balls and to a professional ball player, throwing equivalent speeds of 80+ mph, using Stike 3 plastic balls designed for gym use. It has versatility that is unmatched.

By way of further explanation, Applicant submits that it has been a while since there has been any real new technology for throwing baseballs, but Applicant, who holds other patents in the art, is even surprised at what this super light weight arm with side controls can do. Applicant has always wondered why companies sell machines that cost hundreds of dollars to throw a ball that does not weigh anything. Applicant's present invention provides a hand held throwing apparatus 10 that can be used indoors or for warming up before games or use at home or in the park.

By way of continued explanation, the present invention includes, among other things, the following advantages and features:

Combination throwing-cocking arm 28 is so light and small that is it basically useless by itself, so something holding the ball in the center position, the ball stop device 50 and projections 60 in combination, as it is thrown is required for it to work. Further arm 28 must be long enough to be used to cock the machine easily, but light enough to use only a limited amount of the spring power so as to leave the rest to throw fast and far. The present invention is a very accurate machine and the long arm 28 goes over the top of it, during the throw, and keeps the ball 52 from flying out high, but grooves it down the middle.

The sides 14 and 16 of the U-shaped body 12 on each side make it possible to put the two projections 60 on the back side of the ball 52 so it can be aimed up without the ball 52 rolling down the arm 28. This is very important for teaching youngsters to catch fly balls as regular pitching machines cannot do it and it is hard to accurately place fly balls to beginners any other way. This is also the only way Applicant knows of to teach catchers to catch balls popped straight up above them.

In operation, the spring 36 going past the fulcrum of axle 34 takes the power off the arm 28. The thumb release pad 62 is quick and safer than a trigger release. The thumb release pad 62 is made of rubber so the end of the arm 28 could not cut or scratch anyone if they got in the way.

Speed adjustment slots 44 in the sides 14 and 16 of the U-shaped body 12 allows the operator to quickly change the speeds by slipping the speed adjustment rod 42 into different slots 44 or slide past the slots 44 in spring relaxation slot 48 for shipping or storage purposes.

The ball stop device 50 is located along arm 28 in between the first end 30 and the second end 32 so as to place the ball 52 in the exact position required for an accurate throw. Too far forward and the ball 52 will be thrown too high. Too far back and the ball will be thrown too low. Adjustment slot 54 is useful in providing corrective positioning.

Two linkages, spring connectors 39 (shown in FIG. 2, for example) go on the end of the arm spring attachment stud 37. Preferably, spring connectors are a little over one inch long and the spring(s) 36 hooks to one end. This allows the springs 36 to rotate around the stud 37 without bending around them and this takes almost all pressure off the arm 28 when cocked.

A piece of material forms a front hand stop 66 at the front bottom of the machine to keep the user's 68 hand 72 from being placed too far forward during release and getting in the way of the arm 28.

In one aspect, the arm 28 is reinforced by throwing arm support 33 for the first five or six inches at or near second end 32 by, for example, inserting square aluminum tubing inside the u tubing the arm 28 is made from. That is, in one aspect, arm 28 is U-shaped tubing in order to reduce the weight of arm 28. Throwing arm support 33 reinforces the arm 28 and in one aspect ball stop device 50 is used to secure the arm 28 to the throwing arm support 33. Preferably, throwing arm support 33 ends just after the ball stop device 50 as illustrated.

Again, the arm 28 has very little power because it goes past the fulcrum and the power is transferred to the axle 34. In operation, the thumb is used to hold down the power exerted by the springs 36 prior to releasing the arm 28. Applicant has found that the device does not work as well with torsion springs or any power method that does not transfer the power to the axle and/or leave only slight power for the thumb to hold down. Thus, while a torsion spring, instead of the preferred extension springs 36, could be used, Applicant prefers the extension springs 36 because a thumb can hold down all the power before releasing and the device simply would not work as well without making it that way. Also, the slight pressure that is on the thumb is a ready reminder at all time when it is cocked and ready to throw. A trigger release would be like a rat trap and be dangerous, so the thumb release is also a big part of the device function.

By testing, Applicant has found that he could cock and release the device every two seconds. Also, Applicant was wondering if there would be any effect on the hands. Applicant cocked and released it 1000 times in one period and did not feel any discomfort at all.

The key is that Applicant tried to figure out a way to use as light weight of an arm 28 as possible so the springs 36 do not have to move the weight of an arm and throw a ball at the same time. A u channel aluminum arm 28 was as light as Applicant could find, but fiberglass or any other type of light strong material could be used. The key is that the arm 28 is useless by itself; therefore the two sides 14 and 16 of the machine are needed to hold the ball 52 in place as the force takes over causing the ball 52 to groove down the middle as it is thrown. The length of the arm 28 serves three purposes. One is that it is long enough to give leverage to cock it. The second is to sling the ball 52 with as much force as possible. The third is that it is long enough to come over the ball 52 as it is being released to guide the ball 52 down the middle.

A key to the ease of the way the device works is that the springs 36 go past the fulcrum which transfers the power onto the axle 34 so that arm 28 can be held down with just a thumb and release it when ready. It is easy to cock, but Applicant prefers to use the thumb release because Applicant did not want a rat trap effect of it being cocked. While pad 62 is under the thumb, the slight pressure always keeps the user 68 aware it is cocked and ready to throw.

The description of the present embodiments of the invention has been presented for purposes of illustration, but is not intended to be exhaustive or to limit the invention to the form disclosed. Many modifications and variations will be apparent to those of ordinary skill in the art. As such, while the present invention has been disclosed in connection with an embodiment thereof, it should be understood that other embodiments may fall within the spirit and scope of the invention as defined by the following claims.

What is claimed is:

1. A hand held throwing apparatus comprising:

a. a U-shaped body with two sides and a bottom forming an open interior, the U-shaped body having a length and the open interior extending the entire length such that the U-shaped body includes an open front and an open back;

b. a combination throwing-cocking arm with a first end and a second end wherein the second end is rotatably connected with the U-shaped body in proximity to the open front in between and within said two sides such that said combination throwing-cocking arm fits within said U-shaped body and extends within said open front in one position and extends within said open back in another position;

c. a spring with a first end and a second end, wherein the first end of the spring is attached to the second end of the combination throwing-cocking arm and the second end of the spring is connected with the U-shaped body;

d. a stop device attached to the combination throwing-cocking arm between the first end and the second end extending from the surface of the combination throwing-cocking arm without contacting the U-shaped body;

e. a handle connected to the U-shaped body wherein said handle is connected underneath the open back to the bottom of said U-shaped body such that the open back of said U-shaped body extends over the handle;

f. a spring adjustment rod and spring adjustment slots wherein the second end of the spring is connected to the spring adjustment rod and wherein the spring adjustment rod extends from side to side across the open interior and to the outside of both sides of said U-shaped body and wherein said spring adjustment slots consist of pairs of oppositely positioned spring adjustment slots in the sides of said U-shaped body wherein said spring adjustment slots are conformed to receive and removably retain said spring adjustment rod on both sides of said U-shaped body; and g. a pair of projections connected with said U-shaped body in the open interior of said U-shaped body, said pair of projections consisting of a first projection connected to one side and a second projection connected to the opposite side and wherein the two projections are oppositely positioned and facing each other across the open interior with a space in-between such that the combination throwing-cocking arm passes between the pair of projections in said space wherein in combination said pair of projections, said stop device and said sides hold an object to be thrown when said combination throwing-cocking arm is in a cocked position.

2. The apparatus of claim 1, wherein the spring adjustment rod includes grips wherein said grips extend beyond the sides of the U-shaped body.

3. The apparatus of claim 1 further including a spring relaxation slot connected with said spring adjustment slots wherein said spring relaxation slot extends beneath said spring adjustment slots along a length of said sides of said U-shaped body from said spring adjustments slots toward said open front of said U-shaped body beyond said spring adjustment slots wherein said spring adjustment rod fits within said spring relaxation slot.

4. The apparatus of claim 1 further comprising a holder at the first end of the combination throwing-cocking arm.

5. The apparatus of claim 4 wherein the holder is a pad that extends beyond the first end of the combination throwing-cocking arm and at least partially to either side of the first end of the combination throwing-cocking arm.

6. The apparatus of claim 1 wherein the first end of the combination throwing-cocking arm extends beyond the open front and between and below said sides when uncocked and wherein the first end of the combination throwing-cocking arm is located between and below the sides at the open back when cocked.

7. The apparatus of claim 1 further including a spring attachment stud connected with the second end of the combination throwing-cocking arm wherein more than one spring is connected with the spring attachment stud and wherein more than one spring is also connected with the U-shaped body.

8. A hand held throwing apparatus comprising:

a. a U-shaped body with two sides and a bottom forming an open interior, the U-shaped body having an open front and an open back;

b. a combination throwing-cocking arm with a first end and a second end wherein the second end is rotatably connected with an arm axel, the arm axel connected with the U-shaped body in proximity to the open front in between said two sides and within the open interior;

c. a spring attachment stud connected with the second end of the combination throwing-cocking arm wherein the spring attachment stud is located in between the arm axel and the second end of the throwing-cocking arm;

d. a pair of springs with a first end and a second end, wherein the first ends of the springs are attached to the spring attachment stud such that the arm axel connection is between the first ends of the springs and the first end of the combination throwing-cocking arm;

e. an adjustable stop device attached to the combination throwing-cocking arm between the first end and the second end wherein said adjustable stop device extends from the surface of the combination throwing-cocking arm without contacting the U-shaped body;

f. a spring adjustment rod wherein the second ends of the springs are connected to the spring adjustment rod;

g. spaced apart spring adjustment slots in said U-shaped body wherein said spring adjustment slots are conformed to receive and removably retain said spring adjustment rod;

h. two projections connected with said U-shaped body, a first projection connected to one side and a second projection connected to the opposite side and wherein the two projections are oppositely positioned and facing each other across the open interior with a space between said two projections permitting passage of said throwing-cocking arm wherein said two projections in combination with said adjustable stop device and the sides are configured to support an object to be thrown at a selected position within said sides of said U-shaped body and above said throwing-cocking arm when said throwing-cocking arm is in a cocked position;

i. a handle connected to the U-shaped body at the bottom of the U-shaped body in proximity to the open back and j. a hand stop extending from the bottom of the U-shaped body said hand stop connected to the bottom of the U-shaped body in proximity to the open front end and in front of said spring adjustment slots and spaced apart and separate from said handle with said handle behind said spring adjustment slots.

9. The apparatus of claim 8 wherein the spring adjustment rod extends from side to side across the open interior and wherein said spring adjustment slots consist of pairs of oppositely positioned spring adjustment slots in the sides.

10. The apparatus of claim 9 wherein the spring adjustment rod includes grips wherein said grips extend beyond the sides of the U-shaped body.

11. The apparatus of claim 8 further including a spring relaxation slot connected with said spring adjustment slots wherein said spring adjustment rod fits within said spring relaxation slot and wherein said spring relaxation slot extends beneath said spring adjustment slots along a length of said sides of said U-shaped body from said spring adjustments slots toward said open front of said U-shaped body and beyond said spring adjustment slots.

12. The apparatus of claim 8 further including a holder wherein the holder is a pad connected with the first end of the combination throwing-cocking arm and wherein the holder extends beyond the first end of the combination throwing-cocking arm and at least partially to either side of the first end of the combination throwing-cocking arm.

13. The apparatus of claim 8 wherein the first end of the combination throwing-cocking arm extends beyond the open front and between and below said sides when uncocked and wherein the first end of the combination throwing-cocking arm is located between and below the sides at the open back when cocked.

14. A hand held throwing method comprising:

a. providing a U-shaped body with two sides and a bottom forming an open interior, the U-shaped body having a length and the open interior extending the entire length such that the U-shaped body includes an open front and an open back; a combination throwing-cocking arm with a first end and a second end wherein the second end is rotatably connected with the U-shaped body in proximity to the open front in between and within said two sides such that said combination throwing-cocking arm fits within said U-shaped body and extends within said open front in one position and extends within said open back in another position; a spring with a first end and a second end, wherein the first end of the spring is attached to the second end of the combination throwing-cocking arm and the second end of the spring is connected with the U-shaped body; a stop device attached to the combination throwing-cocking arm between the first end and the second end extending from the surface of the combination throwing-cocking arm without contacting the U-shaped body; and a handle connected to the U-shaped body wherein said handle is connected underneath the open back to the bottom of said U-shaped body such that the open back of said U-shaped body extends over the handle; a spring adjustment rod and spring adjustment slots wherein the second end of the spring is connected to the spring adjustment rod and wherein the spring adjustment rod extends from side to side across the open interior and to the outside of both sides of said U-shaped body and wherein said spring adjustment slots consist of pair of oppositely positioned spring adjustment slots in the sides of said U-shaped body wherein said spring adjustment slots are conformed to receive and removably retain said spring adjustment rod on both sides of said U-shaped body; and a pair of projections connected with said U-shaped body in the open interior of said U-shaped body, said pair of projections consisting of a first projection connected to one side and a second projection connected to the opposite side and wherein the two projections are oppositely positioned and facing each other across the open interior with a space in-between such that the combination throwing cocking arm passes between the pair of projections in said space wherein in combination said pair of projections, said stop device and said sides hold an object to be thrown when said throwing-cocking arm is in a cocked position;

b. grasping the handle;

c. rotating the first end of the combination throwing-cocking arm back to the open back of the U-shaped body;

d. placing an object to be thrown at the stop device while holding the first end; and e. releasing the first end.

15. The method of claim 14 further comprising:

adjusting tension on said spring by placing said spring adjustment rod in one of said spring adjustment slots.

16. The method of claim 14 wherein the first end of the combination throwing-cocking arm extends beyond the open front and between and below said sides when uncocked and wherein the first end of the combination throwing-cocking arm is located between and below the sides at the open back when cocked.

* * * * *